US009010130B2

(12) United States Patent
McCormick

(10) Patent No.: US 9,010,130 B2
(45) Date of Patent: Apr. 21, 2015

(54) VARIABLE SURFACE AREA HEAT EXCHANGER

(75) Inventor: Stephen A. McCormick, Warrington, PA (US)

(73) Assignee: Linde Aktiengesellschaft, Munich (DE)

( * ) Notice: Subject to any disclaimer, the term of this patent is extended or adjusted under 35 U.S.C. 154(b) by 262 days.

(21) Appl. No.: 13/328,299

(22) Filed: Dec. 16, 2011

(65) Prior Publication Data

US 2013/0152618 A1 Jun. 20, 2013

(51) Int. Cl.

| | |
|---|---|
| ***F17C 3/08*** | (2006.01) |
| ***F17C 13/08*** | (2006.01) |
| ***F25D 3/08*** | (2006.01) |
| ***F28F 13/14*** | (2006.01) |
| ***F28F 27/00*** | (2006.01) |

(52) U.S. Cl.
CPC ..... *F28F 13/14* (2013.01); *F28F 27/00* (2013.01); *F28F 2270/00* (2013.01)

(58) Field of Classification Search
USPC ..... 62/48.1, 53.2, 383, 371, 372, 425, 426, 62/516, 517, 52.1
See application file for complete search history.

(56) References Cited

U.S. PATENT DOCUMENTS

| | | | | |
|---|---|---|---|---|
| 3,622,299 | A | 11/1971 | Swillinger | |
| 4,137,038 | A | 1/1979 | Vorobeichikov et al. | |
| 4,353,353 | A | 10/1982 | Keller | |
| 4,424,804 | A * | 1/1984 | Lee | 126/572 |
| 5,170,631 | A | 12/1992 | Lang et al. | |
| 5,172,566 | A * | 12/1992 | Jung et al. | 62/186 |
| 5,467,612 | A * | 11/1995 | Venetucci | 62/374 |
| 5,613,366 | A * | 3/1997 | Schoenman | 62/45.1 |
| 5,737,928 | A | 4/1998 | Lee et al. | |
| 6,408,640 | B1 * | 6/2002 | Garrett et al. | 62/373 |
| 2008/0016901 | A1 * | 1/2008 | Leary | 62/430 |
| 2009/0241557 | A1 * | 10/2009 | Ravex et al. | 62/50.2 |

FOREIGN PATENT DOCUMENTS

| | | |
|---|---|---|
| DE | 36 43 303 A1 | 6/1988 |
| DE | 90 16 792 U1 | 2/1991 |
| DE | 10 2005 05023 A1 | 4/2007 |
| GB | 2 053 444 A | 2/1981 |

OTHER PUBLICATIONS w/European Search Report, Jun. 26, 2012.
European Search Report EP 12 16 1932, Date of Mailing: Jun. 26, 2012, Authorized Officer: J. Mellado Ramirez, 4 pp.
w/Intern Search Report, Jan. 10, 2013.
International Search Report for PCT/US 12/58927, Date of Mailing: Jan. 10, 2013, Authorized Officer: Lee W. Young, 12 pp.

* cited by examiner

*Primary Examiner* — Cheryl J Tyler
*Assistant Examiner* — Elizabeth Martin
(74) *Attorney, Agent, or Firm* — Joshua L. Cohen

(57) ABSTRACT

A heat exchanger apparatus includes a housing having a sidewall defining a chamber in the housing for containing a cryogen; and a first insulation member movably mounted for coaction with the sidewall, the first insulation member moveable to a position to expose or cover a select portion of the sidewall to provide a heat transfer effect.

14 Claims, 6 Drawing Sheets

VARIABLE SURFACE AREA HEAT EXCHANGER

BACKGROUND

The present embodiments relate to apparatus that can adjust a heat transfer surface area during chilling or freezing processes.

Known freezing systems that are used in, for example, in transit refrigeration (ITR) include mechanical compression refrigeration driven by diesel fuel motors, bunkers filled with $CO_2$ dry ice, or $CO_2$ liquid that is vaporized through heat exchangers mounted inside a refrigerated space and then discharged to an exterior of the space. The air inside the refrigerated space is cooled by forced or natural convection over the surface of the heat exchanger for the mechanical compression refrigeration system, the dry ice bunker or the liquid $CO_2$ heat exchanger. The air temperature inside the refrigerated space will usually be either 0° F. (−18° C.) for a frozen food product, or 34° F. (1° C.) for a chilled product.

Precise temperature control of the air in the space using a mechanical compression refrigeration system is difficult, due to a low temperature difference between the refrigerant temperature and the desired air temperature and thus, a limited heat transfer rate. In addition, for refrigeration systems installed in trailers, the trailer doors are frequently opened for deliveries providing frequent rapid increases in trailer heat load. Precise temperature control of the air in the space is difficult for dry ice bunker systems because the heat exchanger surface always remains at minus 109° F. (−78° C.), and once that temperature is reached the heat transfer cannot be reduced. Therefore, air temperature will drop below the desired set point. Failure to maintain proper temperature control in the space may cause the temperature to be reduced to a rate below that which is acceptable for the product to be transported, and thereby damage the product.

In order to compensate for the anticipated increase in heat load, air temperature within the space will frequently be reduced to a temperature that is lower than desirable for the product being transported. This makes food products especially susceptible to damage, and will therefore likely result in the system efficiency being lowered in order to obtain the proper temperature control for the space.

Known systems also have a cold surface at the heat exchanger which tends to become covered in frost that has been condensed from air external to the refrigerated space being permitted to come into the space (such as when trailer doors are opened to access the product), thereby causing variation in heat transfer rate and potential loss of temperature control for the space. It is desirable to eliminate the frost build up on the heat exchanger surface and provide for a more uniform and consistent temperature of the product and the refrigeration space.

BRIEF DESCRIPTION OF THE DRAWINGS

For a more complete understanding of the present inventive embodiment disclosures, reference may be had to the following drawing figures taken in conjunction with the description of the embodiments, of which.

DETAILED DESCRIPTION OF THE INVENTION

Figure 1:
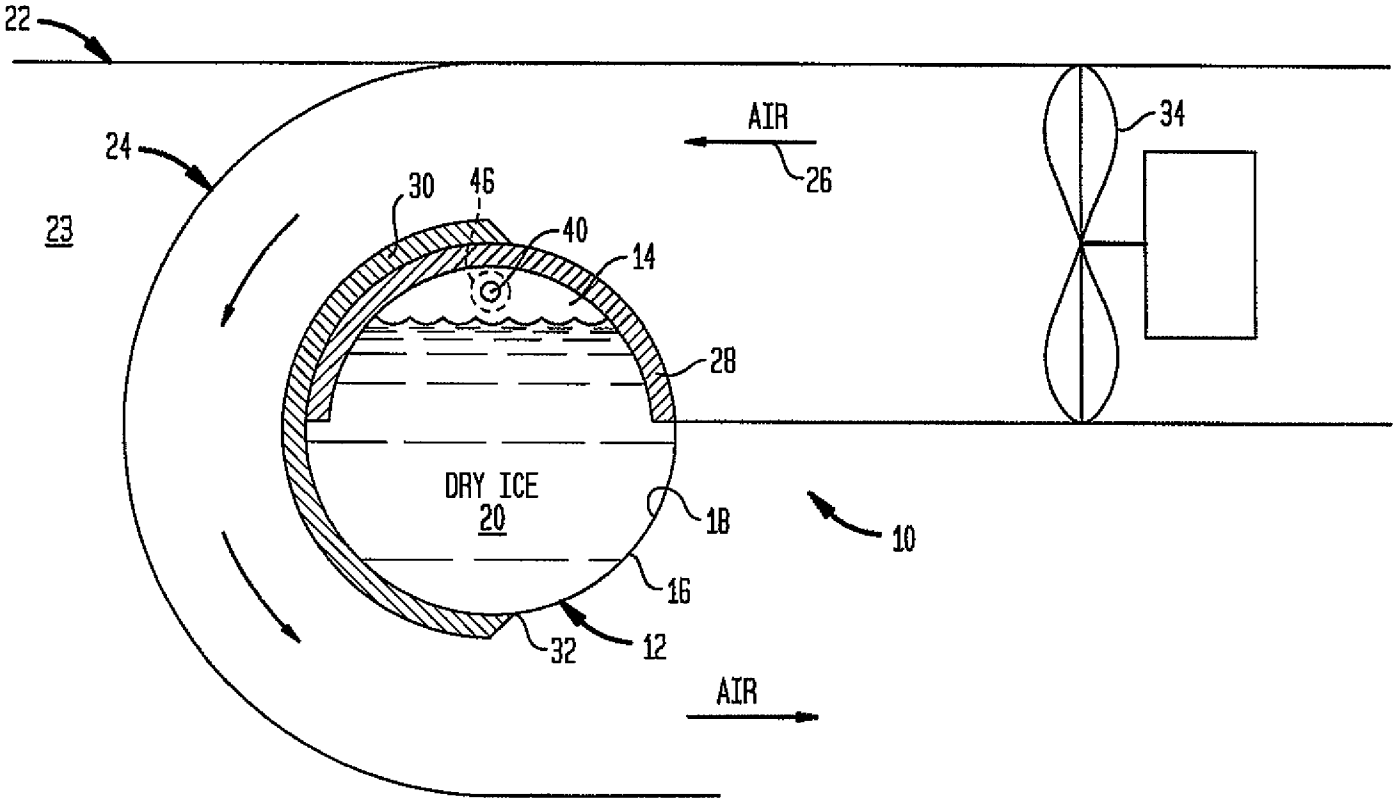
FIG. 1 shows a side, cross-sectional view of a variable surface area heat exchanger embodiment.

Referring to FIG. 1, a variable surface area heat exchanger embodiment is shown generally at 10. The heat exchanger apparatus 10 includes a sidewall 12 for defining a space 14 or chamber within the apparatus. The sidewall 12 has an exterior surface 16 and an interior surface at 18. Dry ice 20 is contained within the space 14 or alternatively $CO_2$ gas can be introduced into the space as described hereinafter. The heat exchanger 10 may be constructed from stainless steel, aluminum or plastic and has a tube-like shape with a cross-sectional diameter of for example approximately 6 inches, while a width of the heat exchanger would extend substantially across a width of a container 22 in which the heat exchanger is disposed for operation. A shroud 24 is provided for the heat exchanger 10 to prevent the heat exchanger from being inadvertently contacted by personnel or products in containment space 23 of the container 22, and to provide a pathway for airflow 26 to be directed over the surface 16 of the heat exchanger. The shroud 24 may be mounted to the container 22 by mechanical fasteners (not shown) for example.

The heat exchanger 10 has a portion thereof insulated to prevent heat transfer to the air flow 26 being directed to the heat exchanger. An insulation layer 28 or member is mounted to the interior surface 18 of the sidewall 12 and covers a select portion of said interior surface. The insulation layer 28 may be constructed of high density foam or polystyrene, or be vacuum insulated. The insulation layer 28 is fixed to the interior surface 18 of the sidewall 12 or may be formed integral therewith.

As shown by way of example only with respect to FIGS. 1-5, the insulation layer 28 is mounted to cover one-half the interior surface 18 of the sidewall 12. The sidewall 12 is shown having a circular cross-section and therefore, the insulation layer 28 is provided with an arcuate or curved shape to be nested against the interior surface 18 of the sidewall 12. The remaining area of the interior surface 18 remains uninsulated and therefore, provides heat transfer when the air flow 26 is exposed to the sidewall 12.

Figure 2:
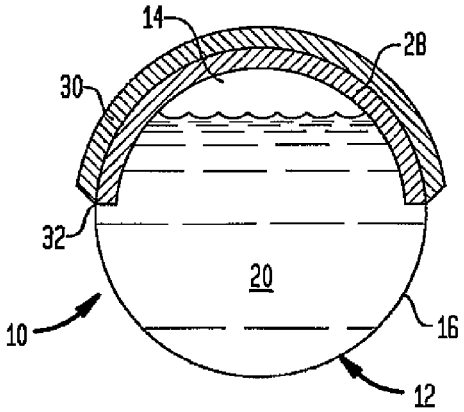
FIGS. 2-5 show end views in cross-section of portions of the embodiment of FIG. 1 in various stages of operation.
Figure 4:
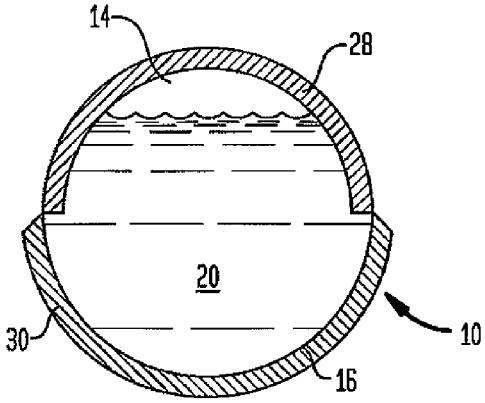

A moveable insulated shield 30 or member is disposed for rotational movement along the exterior surface 16 of the sidewall 12. The shield 30 has an arcuate shape in order to operate as described below. Referring also to FIGS. 2-5, it is seen that movement of the shield 30 with respect to and along the exterior surface 16 can bring about providing further insulation to that portion of the sidewall 12 which is not provided with the insulation layer 28. The arcuate or curved shape of the shield 30 permits the shield to be nested against the exterior surface 16 for movement along said surface. The shield 30 can therefore either completely cover the uninsulated half of the sidewall 12 as shown in FIG. 4, thereby stopping heat transfer; or can be fully retracted in registration with the insulation layer 28 at an opposite side of the sidewall as shown in FIG. 2, thereby providing maximum heat transfer. The moveable shield 30 can therefore be positioned as shown in FIGS. 2-5 to provide various levels of heat transfer, depending upon the position of the shield 30 with respect to the insulation layer 28. This form of construction of the heat exchanger 10 provides for the variable heat transfer surface area and variable heat transfer rate for the air flow 26 inside the refrigerated space of the container 22.

As shown in FIG. 4, a length of each one of the insulation layer 28 and the shield 30 combined can equal 360°. However, the heat exchanger 10 can certainly be provided with an insulation layer 28 having a length of for example 270°, while the moveable shield 30 would have a length of 90°. What is required is that the combined lengths of each of the insulation layer 28 and the shield 30 total at least 360°, if the chamber 14 has a circular cross-section, so that when the shield is moved into position as shown in FIG. 4, no heat transfer is provided by the apparatus 10.

The degree of cooling in the container 22 by the heat exchanger 10 can be controlled by rotation of the shield 30 along the exterior surface 16 of the sidewall 12 to thereby vary the exposed exterior surface area. The shield 30 is mounted to the sidewall 12 so that when the shield is moved or rotated it hugs or glides along the exterior surface 16 of the sidewall. The shield 30 can be manufactured from a material similar to that which is used to manufacture the insulation layer 28. If the shield 30 is manufactured from stainless steel or aluminum, such could have a core of high density foam or polystyrene; or even a vacuum insulated core.

Figure 3:
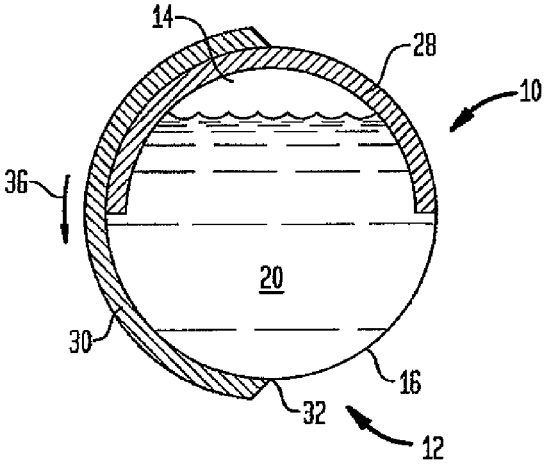
Figure 5:
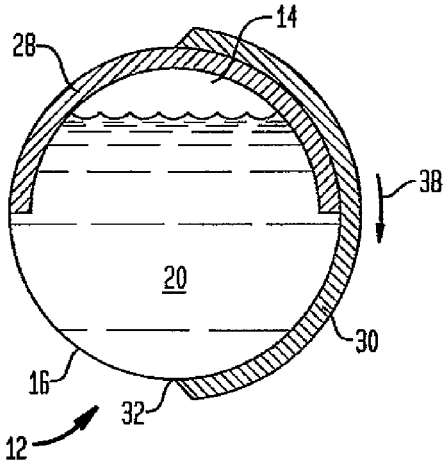

The shield 30 is also provided with at least one knife edge 32. When the shield 30 is moved in, for example, the counter-clockwise direction as shown in FIGS. 1 and 3, the knife edge 32 will scrape or shave any frost which may have accumulated or built-up on the exterior surface 16 when same was exposed to the airflow 26 for heat transfer. Therefore, rotating the moveable shield 30 into position from FIG. 2 to FIG. 3, to provide the necessary amount of heat transfer, will cause the knife edge 32 to scrape and clean the exterior surface 16 so that build-up of frost is prevented and removed, and the efficiency of the heat exchanger 10 is maintained. Removal of the frost build-up is also necessary in order to be able to move the shield 30 into and out of position with respect to the insulation layer 28. If too much frost is permitted to build-up, the shield 30 will not be able to rotate or move into the desired position with respect to the insulation layer 28 in order to provide the necessary amount of heat transfer.

As shown in FIG. 1, a fan 34 or fans can be used to provide the air flow 26 through the shroud 22 for contacting the heat exchanger 10.

Referring still to FIGS. 2-5, FIG. 2 shows the heat exchanger 10 with the moveable shield 30 fully retracted into an overlapping position with respect to the insulation layer 28 so that the maximum heat transfer effect can be provided. FIG. 3 discloses the moveable shield 30 being moved into position as indicated by arrow 36 to have the heat transfer effect reduced. FIG. 4 shows the shield 30 fully moved to a position to cover the remaining exposed area of the exterior surface 16 so that there is no heat transfer effect provided by the heat exchanger 10. Alternatively, the shield 30 can be moved in a clockwise direction as shown by arrow 38, which will result in the shield eventually arriving at the position shown in FIG. 4.

Figure 6:
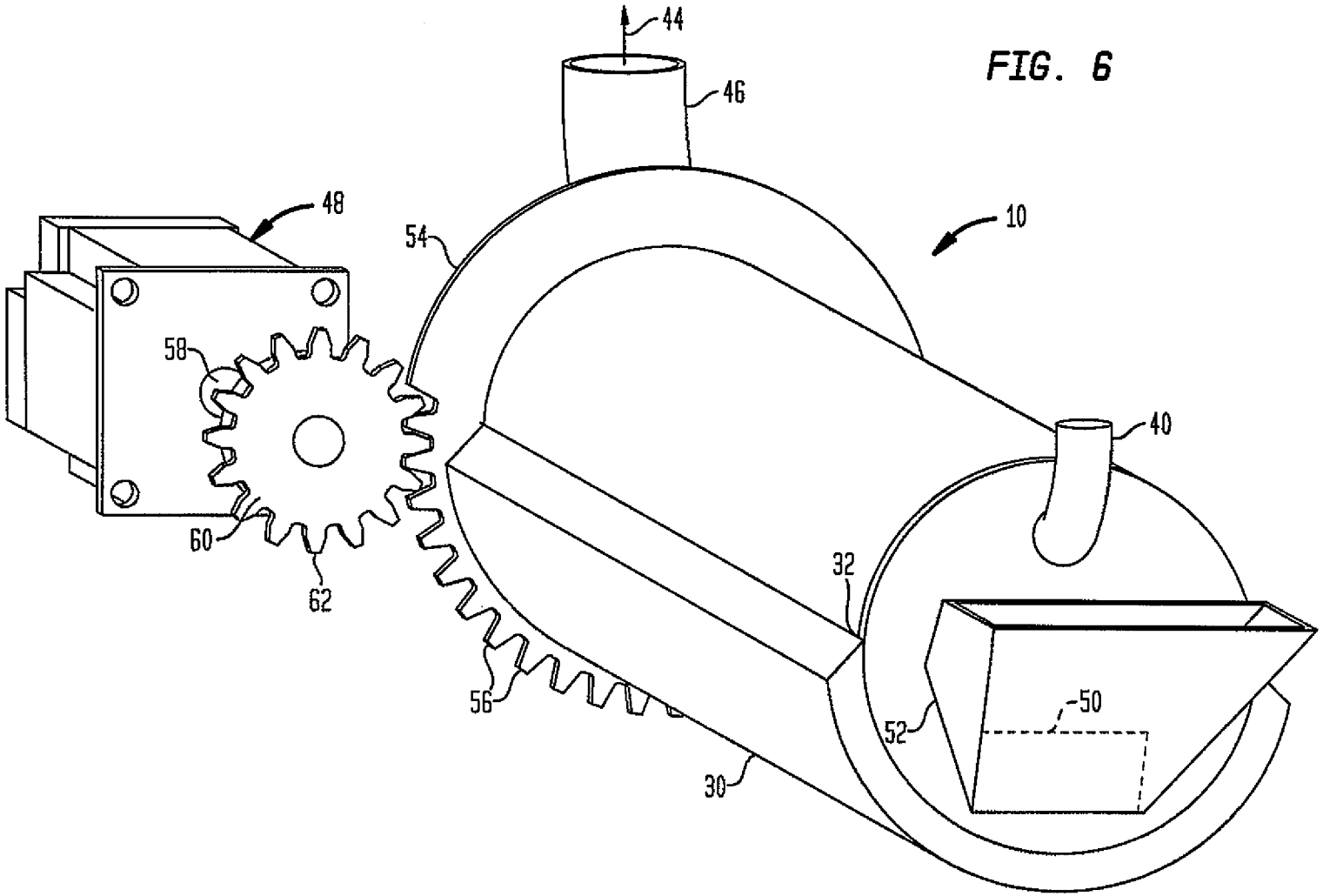
FIG. 6 shows a top perspective view of the heat exchanger embodiment with a mechanical drive assembly.
Figure 7:
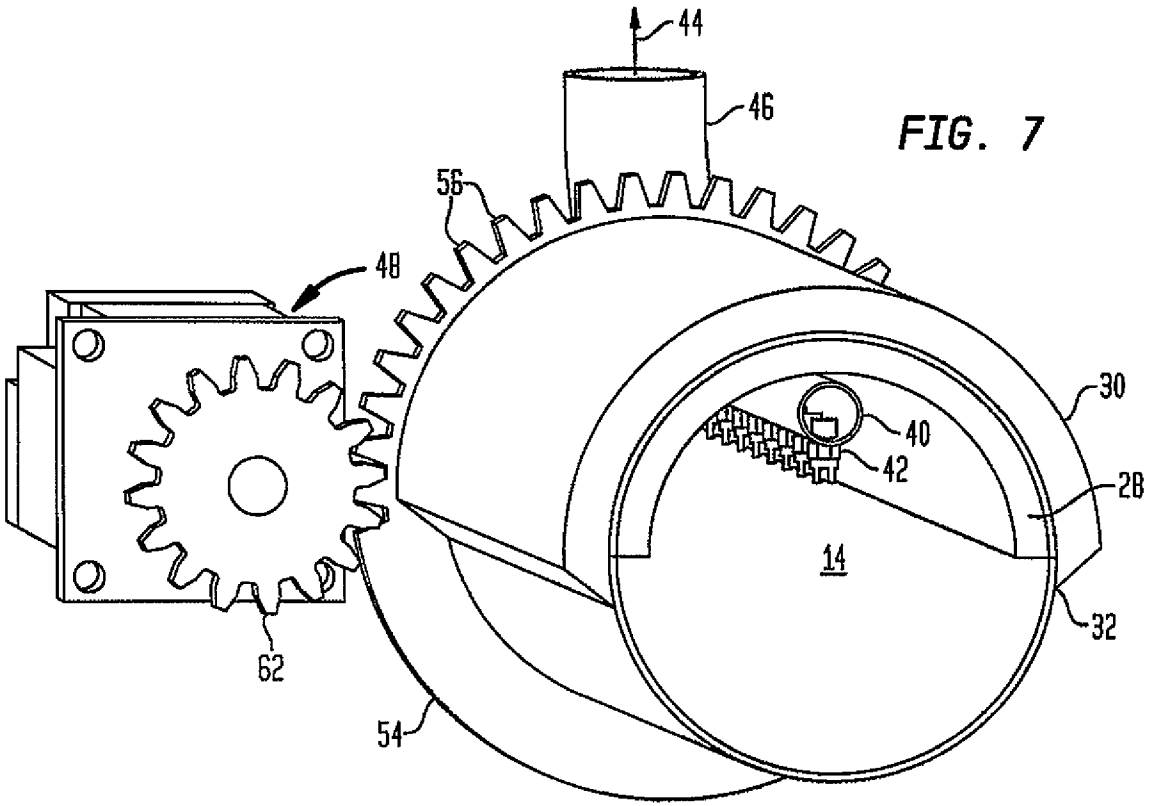
FIG. 7 shows a partial cross-section of the embodiment in FIG. 6.

Referring to FIGS. 6-7, movement or rotation of the shield 30 can be by known mechanical or electrical devices, such as those that use a servo motor 48.

The moveable shield 30 is provided at an end thereof with a gear flange 54 or collar having at least a portion thereof provided with a plurality of teeth 56. The teeth 56 extend substantially along an edge of the gear flange 54, and certainly at least to an extent necessary to move the shield 30 into the necessary position with respect to the insulation layer 28 in order to provide the desired amount of heat transfer. The servo motor 48 has a shaft 58 extending therefrom which has at an end thereof a gear 60 with a plurality of teeth 62 sized and shaped for being in registration and coacting with teeth 56 of the gear flange 54. With this construction, the servo motor 48 drives the shaft 58 and in turn the gear 60; the teeth 62 coacting with the teeth 56 of the gear flange 54 to rotate the moveable shield 30 into the necessary position with respect to the sidewall 12. The coaction of the insulation layer 28 and the shield 30 adjusts the heat transfer effect that can be provided at the sidewall 12.

The apparatus 10 can be filled or charged with cryogen in different phases. An end portion 51 of the sidewall 12 can be provided with a door 50 or flap through which the dry ice 20 can be introduced into the space 14. A chute 52, charging funnel or hopper is mount to the end portion 51 in registration with the door 50 so that the dry ice 20 in the form of pellets can be introduced into the space 14 for providing the heat transfer effect.

Figure 8:
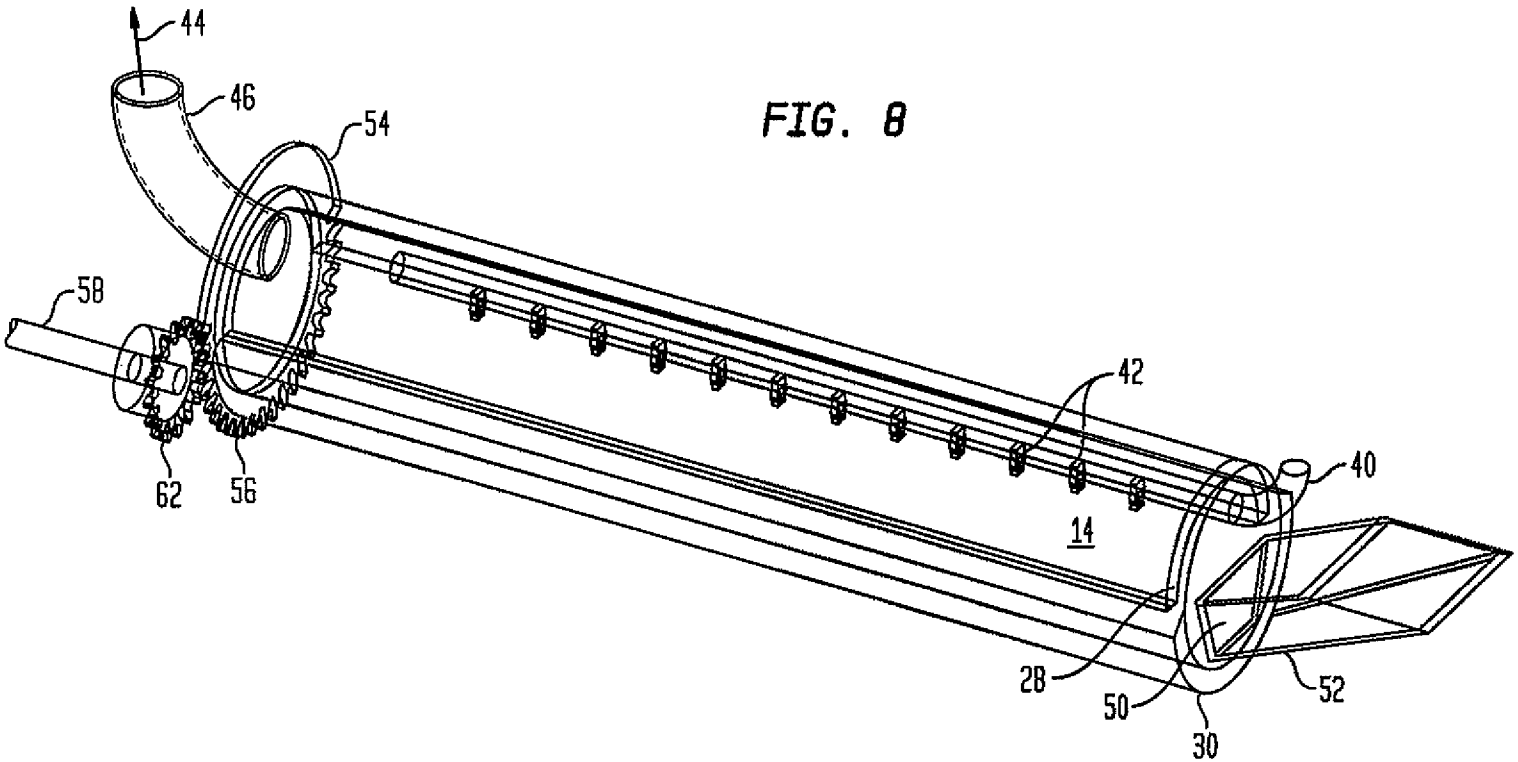
FIG. 8 shows an isometric view of the heat exchanger apparatus embodiment.

Alternatively, the cryogen introduced into the apparatus 10 can be provided as liquid cryogen introduced through an inlet pipe 40 or fill pipe which may extend substantially across the space 14 as shown in FIG. 8, and having a plurality of nozzles 42 in communication therewith as shown in FIG. 7. The liquid cryogen is exhausted through the nozzles 42 into the chamber 14 where it expands into gas and solid phase to provide the heat transfer effect for the sidewall 12. Exhaust 44 is removed from the space 14 through outlet pipe 46. The liquid cryogen can be introduced as liquid $CO_2$ into the fill pipe 40.

Figure 9:
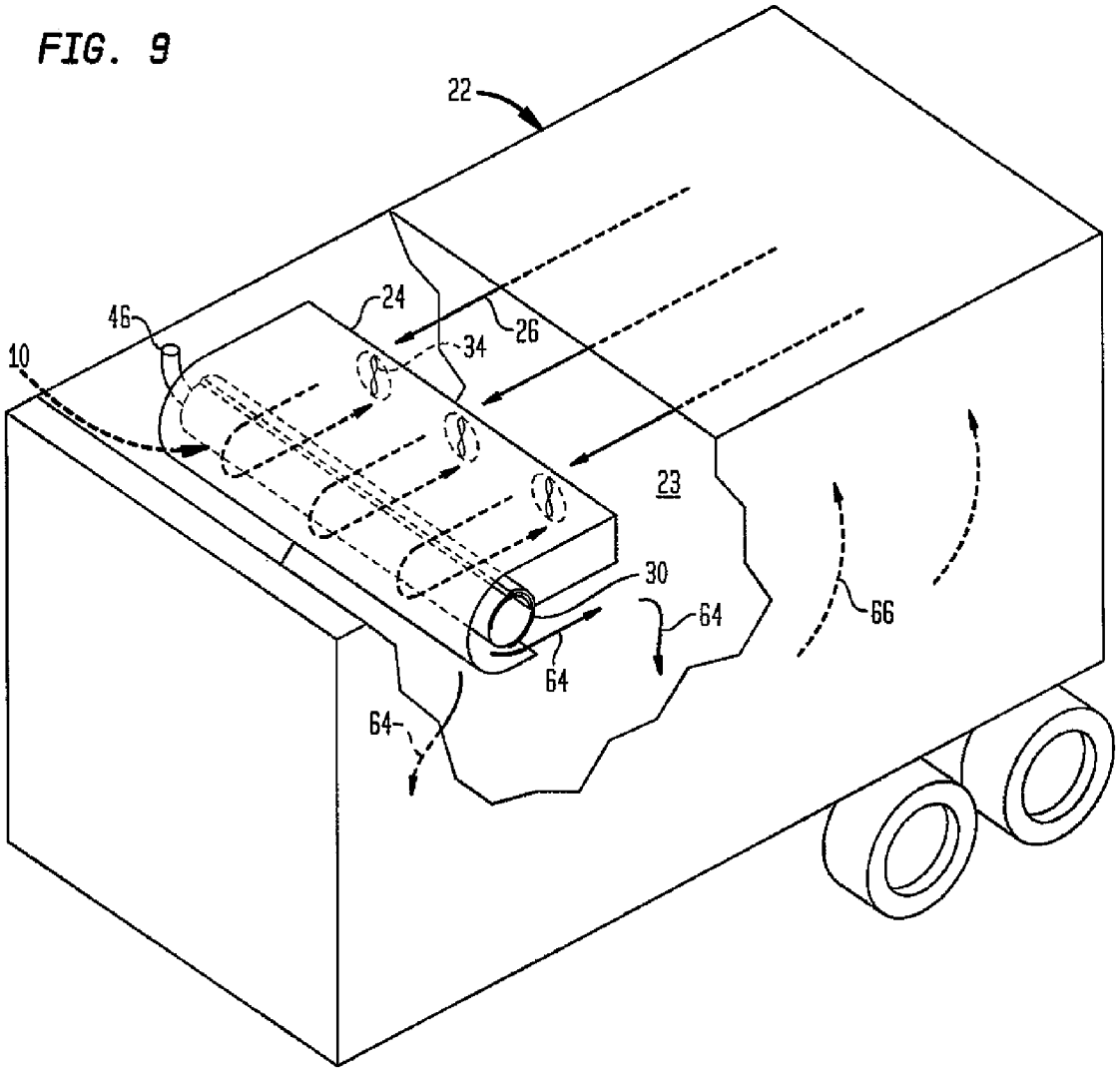
FIG. 9 shows the heat exchanger apparatus embodiment mounted for operation in a container.

As shown in FIG. 9, the heat exchanger embodiment 10 is disposed for operation in the container 22. See also FIG. 1. The airflow 26 in the container 22 is drawn in by the fans 34 to pass across and contact the exterior surface 16 of the heat exchanger. Of course, that portion of the exterior surface 16 which must be exposed is controlled by movement of the moveable shield 30 with respect to the sidewall 12. The airflow 26 is cooled and exhausted as shown by arrows 64 for circulation into and throughout the containment space 23. As the chilled airflow 64 begins to warm from its exposure to products in the containment space 23, such warmer air begins to rise as represented by arrows 66, and return to and drawn in as the airflow 26 to the heat exchanger apparatus 10 for a subsequent pass over the heat exchanger.

It will be understood that the embodiments described herein are merely exemplary, and that one skilled in the art may make variations and modifications without departing from the spirit and scope of the invention. All such variations and modifications are intended to be included within the scope of the invention as described and claimed herein. Further, all embodiments disclosed are not necessarily in the alternative, as various embodiments of the invention may be combined to provide the desired result.

What is claimed is:

1. A heat exchanger apparatus, comprising:

a housing having a sidewall defining a chamber within the housing containing a cryogen; wherein an airflow is directed over an exterior surface of the sidewall effecting heat transfer at the sidewall; a first insulation member being movable along the exterior surface of the sidewall, the first insulation member coacting with the sidewall and exposing or covering a select portion of the exterior surface; and a second insulation member fixedly mounted in the chamber and insulating a portion of an interior surface of the sidewall, the first insulation member and the second insulation member coacting with each other from opposite surfaces of the sidewall to provide a select amount of the heat transfer effect at the sidewall.

2. The apparatus of claim 1, wherein the cryogen is a substance selected from the group consisting of dry ice and liquid carbon dioxide ($CO_2$).

3. The apparatus of claim 2, further comprising an inlet formed at a side of the housing through which the dry ice may be introduced into the chamber, and a chute operatively associated with the inlet for guiding the dry ice to the inlet.

4. The apparatus of claim 1, wherein the first insulation member comprises a knife edge for removing frozen cryogen from the sidewall.

5. The apparatus of claim 1, wherein the first insulation member is manufactured from a material selected from the group consisting of stainless steel, aluminum, stainless steel with a foam core, stainless steel with a polystyrene core, aluminum with a foam core, and aluminum with a polystyrene core; and the second insulation member is manufactured from a material selected from the group consisting of high density foam and polystyrene.

6. The apparatus of claim 1, wherein the sidewall comprises a circular cross-section, and the first insulation member has a first arcuate shape conforming to the exterior surface of the sidewall, and the second insulation member has a second arcuate shape conforming to the interior surface of the sidewall.

7. The apparatus of claim 6, wherein a first length of the first arcuate shape and a second length of the second arcuate shape total 360°.

8. The apparatus of claim 1, further comprising a shroud having a space therein for receiving the housing, an inlet in communication with the space and an outlet in communication with the space.

9. The apparatus of claim 8, further comprising at least one fan operatively associated with the inlet for directing the airflow into the inlet and the space for contacting the housing.

10. The apparatus of claim 1, wherein the first insulation member comprises a first plurality of teeth extending therefrom.

11. The apparatus of claim 10, further comprising a drive apparatus having a drive gear with a second plurality of teeth sized and shaped for coaction with the first plurality of teeth of the first insulation member.

12. The apparatus of claim 2, further comprising an inlet pipe extending through the chamber for receiving the liquid carbon dioxide, and at least one nozzle operatively associated with the inlet pipe and in communication with the liquid carbon dioxide for releasing cryogen vapor into the chamber.

13. The apparatus of claim 1, further comprising a container in which the housing is mounted for providing the heat transfer effect to an interior of the container.

14. The apparatus of claim 1, wherein the housing is operatively associated with an in-transit-refrigeration container.

* * * * *